US007523781B2

(12) United States Patent
Oh et al.

(10) Patent No.: US 7,523,781 B2
(45) Date of Patent: Apr. 28, 2009

(54) HEAT EXCHANGER

(75) Inventors: Kwangheon Oh, Daejeon-si (KR); Hongyoung Lim, Daejeon-si (KR)

(73) Assignee: Halls Climate Control Corporation, Daejeon-Si (KR)

( * ) Notice: Subject to any disclaimer, the term of this patent is extended or adjusted under 35 U.S.C. 154(b) by 323 days.

(21) Appl. No.: 11/336,705

(22) Filed: Jan. 20, 2006

(65) Prior Publication Data

US 2006/0162911 A1 Jul. 27, 2006

(30) Foreign Application Priority Data

Jan. 24, 2005 (KR) ..... 10-2005-0006303
Jan. 24, 2005 (KR) ..... 10-2005-0006316
Jan. 4, 2006 (KR) ..... 10-2006-0000842

(51) Int. Cl.
*F28D 1/02* (2006.01)
*F28D 7/06* (2006.01)
*F28F 9/02* (2006.01)

(52) U.S. Cl. ..... 165/153; 165/174; 165/176

(58) Field of Classification Search ..... 165/176, 165/153, 174
See application file for complete search history.

(56) References Cited

U.S. PATENT DOCUMENTS 5,918,664 A * 7/1999 Torigoe ..... 165/78
6,321,834 B1 * 11/2001 Higashiyama ..... 165/153
6,401,804 B1 * 6/2002 Shimoya et al. ..... 165/70
6,705,386 B2 * 3/2004 Demuth et al. ..... 165/42
7,013,952 B2 * 3/2006 Park et al. ..... 165/78
7,021,371 B2 * 4/2006 Saito et al. ..... 165/153
7,040,385 B2 * 5/2006 Higashiyama ..... 165/153
7,228,885 B2 * 6/2007 Kolb et al. ..... 165/42
7,347,248 B2 * 3/2008 Kolb et al. ..... 165/42
7,398,820 B2 * 7/2008 Inaba ..... 165/153
2004/0134645 A1 * 7/2004 Higashiyama ..... 165/153

FOREIGN PATENT DOCUMENTS

CA 2 358 890 A1 4/2002
EP 1 562 014 A1 8/2005
JP U-63-173673 * 4/1987
JP 7-12778 3/1995
WO WO 2005/057098 A1 6/2005

* cited by examiner

*Primary Examiner*—Cheryl J Tyler
*Assistant Examiner*—Brandon M Rosati
(74) *Attorney, Agent, or Firm*—Fulbright & Jaworski L.L.P.

(57) ABSTRACT

The present invention relates to a heat exchanger, in which inlet and outlet side heat exchange parts are communicated with each other and have the same refrigerant flowing direction by communicating pairs of cups with each other which are located at a predetermined area of the center of the heat exchanger, thereby being easily reduced in size, providing uniform surface temperature distribution and improving heat exchange efficiency by reducing the preponderance and the pressure drop rate of refrigerant and inlet and outlet pipes being easily arranged forward.

5 Claims, 14 Drawing Sheets

HEAT EXCHANGER

This application claims priority from Korean Patent Application No: 2005-6303 filed Jan. 24, 2005, Korean Patent Application No: 2005-6316 filed Jan. 24, 2005 and Korean Patent Application No: 2006-842 filed Jan. 4, 2006, each of which is incorporated by reference in its entirety.

BACKGROUND OF THE INVENTION

1. Field of the Invention

The present invention relates to a heat exchanger, and more particularly, to a heat exchanger, in which inlet and outlet side heat exchange parts are fluidically communicated with each other and have the same refrigerant flowing direction by fluidically intercommunicating pairs of cups which are located at a predetermined area of the center of the heat exchanger, thereby being easily reduced in size, providing uniform surface temperature distribution of the heat exchanger and improving heat exchange efficiency by reducing the preponderance and the pressure drop rate of refrigerant and inlet and outlet pipes being easily arranged forward.

2. Background Art

In general, a heat exchanger includes a flow channel for allowing a flow of heat exchange medium therein, so that the heat exchange medium exchanges heat with the external air. The heat exchanger is used in various air conditioning devices, and is employed in various forms such as an evaporator, a condenser, a radiator and a heater core according to various using conditions.

The evaporator of the various heat exchangers is divided according to structural types of refrigerant passageways. Representatively, there are a serpentine type multilayerly bending one collapsible tube and a laminate type formed by piling up dimple type plates. In addition, recently, an evaporator using plural collapsible tubes has been introduced.

As an example of such conventional evaporator, Japanese Utility Model Publication No. 7-12778 discloses an evaporator. Referring to FIG. 1, the evaporator 1 includes a plurality of tubes each of which is formed by bonding two plates 11 having pairs of cups 12 at the upper and lower end thereof. The plural tubes are laminated in multi layers.

The evaporator which is formed by laminating the plural tubes includes tanks 2 and 3 formed on the upper and lower portions thereof, and inlet and outlet pipes 4 and 5 disposed at a side therefore for flow-in and flow-out of refrigerant.

Therefore, an inlet side heat exchange part 20*a* is formed at a part fluidically communicated with the inlet pipe 4, and an outlet side heat exchange part 20*b* is formed at a part fluidically communicated with the outlet pipe 5.

Furthermore, a fluid communication part 25 is mounted at a part of the evaporator opposed to the inlet and outlet pipes 4 and 5 for fluidically communicating the inlet side heat exchange part 20*a* with the outlet side heat exchange part 20*b*.

Meanwhile, partition walls 26 are formed inside the upper tank 2 in a row for dividing the inlet and outlet side heat exchange parts 20*a* and 20*b* into a plurality of heat exchange zones 21 to 24, and heat radiation fins 15 are interposed between the tubes 10 for promoting heat exchange.

Referring to FIG. 2, a flow of refrigerant of the evaporator 1 will be described hereinafter.

Refrigerant induced into the upper tank 2 of the inlet side heat exchange part 20*a* through the inlet pipe 4 flows downwardly at the first heat exchange zone 21 divided by the partition wall 26, and then, moves into the lower tank 3. Refrigerant flowing into the lower tank 3 is returned at the lower tank 3, flows upwardly at the second heat exchange zone 22, and moves into the upper tank 2.

Refrigerant passing through the inlet side heat exchange part 20*a* is induced into the upper tank 2 of the outlet side heat exchange part 20*b* through the fluid communication part 25.

Refrigerant induced into the upper tank 2 of the outlet side heat exchange part 20*b* flows downwardly at the third heat exchange zone 23 divided by the partition wall 26, and moves into the lower tank 3. Refrigerant flowing into the lower tank 3 is returned at the lower tank 3, flows upwardly at the fourth heat exchange zone 24, and moves into the upper tank 2. After that, refrigerant is discharged to the outside through the outlet pipe 5.

In the meantime, the first heat exchange zone 21 is a zone where refrigerant of the upper tank 2 flows downwardly along the tube 10 and moves into the lower tank 3. At this time, since gravity is applied to refrigerant flowing inside the upper tank 2, the volume of refrigerant induced into each tube 10 is gradually increased at the first half stage of refrigerant inducement, but is gradually decreased at the second half stage.

The second heat exchange zone 22 is a zone where refrigerant induced into the lower tank 3 from the first heat exchange zone 21 flows upwardly along the tube 10 and is induced into the upper tank 2. Since inertia is applied to refrigerant flowing inside the lower tank 3, the volume of refrigerant induced into each tube 10 is gradually decreased at the first half stage of the refrigerant inducement, but is gradually increased at the second half stage.

The third heat exchange zone 23 is a zone where refrigerant induced into the upper tank 2 through the fluid communication part 25 from the second heat exchange zone 22 flows downwardly along the tube 10 and moves into the lower tank 3. At this time, since gravity is applied to refrigerant flowing inside the upper tank 2, the volume of refrigerant induced into each tube 10 is gradually increased at the first half stage of the refrigerant inducement, but is gradually decreased at the second half stage.

The fourth heat exchange zone 24 is a zone where refrigerant induced into the lower tank 3 from the third heat exchange zone 23 flows upwardly along the tube 10 and is induced into the upper tank 2. Since inertia is applied to refrigerant flowing inside the lower tank 3, the volume of refrigerant induced into each tube 10 is gradually decreased at the first half stage of the refrigerant inducement, but is gradually increased at the second half stage.

Therefore, there occurs a severe surface temperature difference of the evaporator 1 due to lopsidedness of refrigerant, and it occurs more severely when the flow amount of refrigerant is small or the air passing through the evaporator 1 is in a low airflow. That is, inside the inlet and outlet side heat exchange parts 20*a* and 20*b*, an overcooled section is formed in the tube 10 in which refrigerant of large quantity flows and an overheated section is formed in the tube in which refrigerant of small quantity flows.

Moreover, in the above flow channel structure, the overcooled section and the overheated section are formed at nearly similar locations of the inlet side heat exchange part 20*a* and the outlet side heat exchange part 20*b*. Most of the air passing through the overcooled section of the outlet side heat exchange part 20*b* passes through the overcooled section of the inlet side heat exchange part 20*a*, and most of the air passing through the overheated section of the outlet side heat exchange part 20*b* passes through the overheated section of the inlet side heat exchange part 20*a*. Therefore, the air passing between all of the tubes 10 does not exchange heat uniformly, and so, the temperature distribution difference of the discharged air becomes more severe. In addition, a problem of icing may occur on the surface of the evaporator and the air-conditioner system becomes unstable in the overcooled section. Additionally, in the overheated section, since the discharged air is not normally cooled and dehumidified, temperature-increased damp air is induced into a car, and thereby, passengers may feel uneasiness.

A pressure drop rate of refrigerant is increased by the fluid communication part 25 separately mounted at an end of the tank 2 for fluidically communicating the inlet side heat exchange part 20*a* with the outlet side heat exchange part 20*b*, and so, it causes deterioration of heat exchange performance, and obstructs miniaturization of the heat evaporator.

Furthermore, the conventional evaporator has another problem in that it is difficult to arrange the inlet pipe 4 and the outlet pipe forward since they are all arranged at one side of the evaporator 1.

SUMMARY OF THE INVENTION

Accordingly, to solve the above disadvantages of the prior arts, it is an object of the present invention to provide a heat exchanger, in which inlet and outlet side heat exchange parts are fluidically communicated with each other and have the same refrigerant flowing direction by fluidically communicating pairs of cups with each other which are located at a predetermined area of the center of the heat exchanger, thereby being easily reduced in size, providing uniform surface temperature distribution and improving heat exchange efficiency by reducing the preponderance and the pressure drop rate of refrigerant, and inlet and outlet pipes being easily arranged forward, and by mutually complementarily exchanging heat between the inlet and outlet side heat exchange parts.

To accomplish the above objects, according to the present invention, there is provided a heat exchanger comprising: A heat exchanger comprising: a plurality of tubes, each being formed by bonding a pair of plates with each other, the tube having two discrete flow channels formed therein, a partition bead interposed between the two flow channels, pairs of cups formed at the upper and lower ends thereof in a row and fluidically communicating with each flow channel, and upper and lower tanks formed by coupling the cups; inlet and outlet pipes respectively fluidically communicated with the flow channels for flow-in and flow-out of refrigerant; an inlet side heat exchange part fluidically communicated with the inlet pipe at the tubes; an outlet side heat exchange part fluidically communicating with the outlet pipe at the tubes; fluid communication means for fluidically communicating predetermined areas of the tanks to which the inlet and/or outlet pipes are mounted by fluidically communicating the inlet and outlet side heat exchange parts with each other in such a fashion that they have the same refrigerant flowing direction; and blank plates dividing the inlet and outlet side heat exchange parts into a plurality of heat exchange zones, the blank plates being formed by closing cups located diagonally on both ends of the fluid communication means in such a fashion that portions of the heat exchange zones fluidically communicating with each other via the fluid communication means are mutually overlapped.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 1:
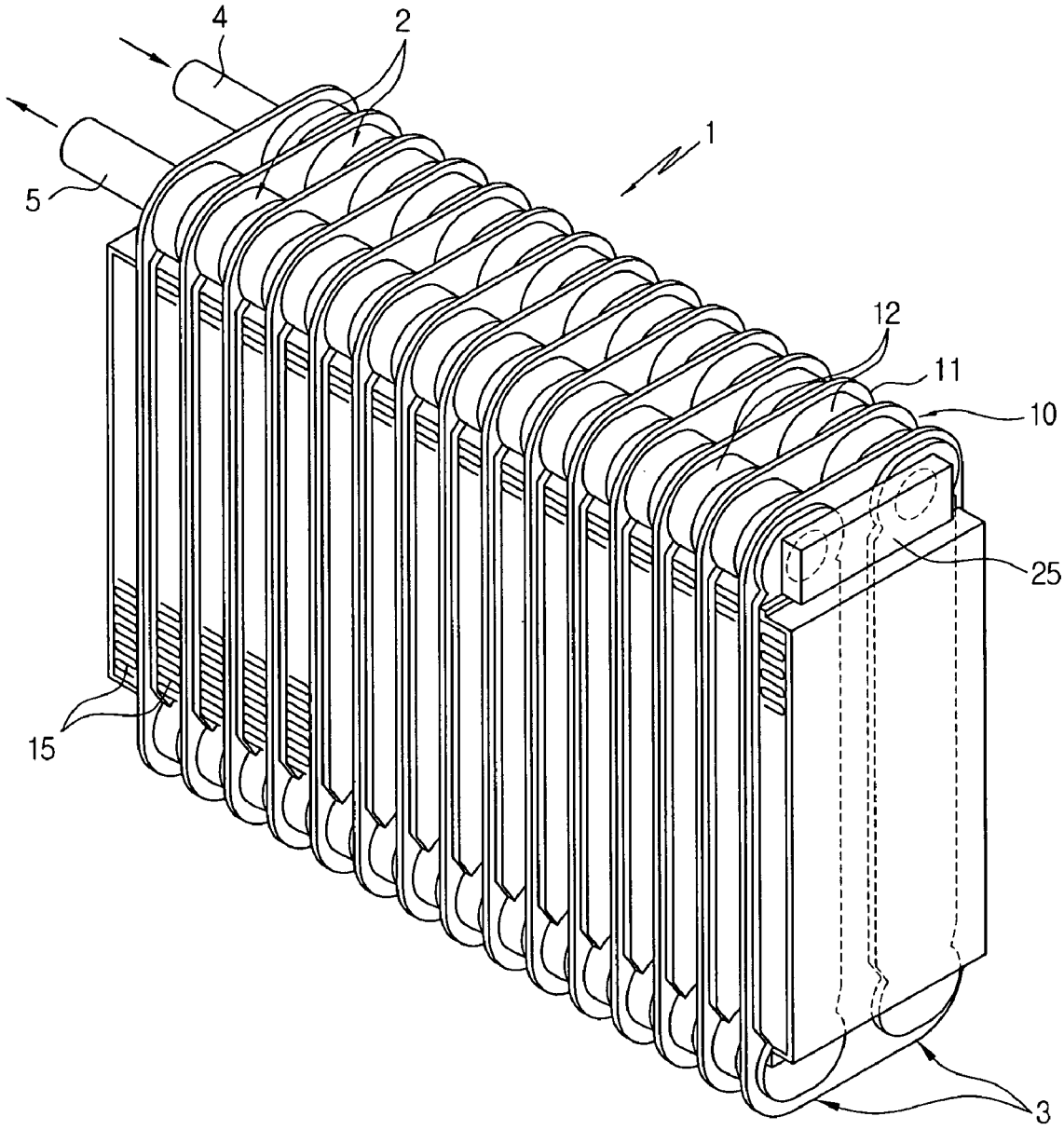
FIG. 1 is a perspective view of a conventional heat exchanger.
Figure 2:
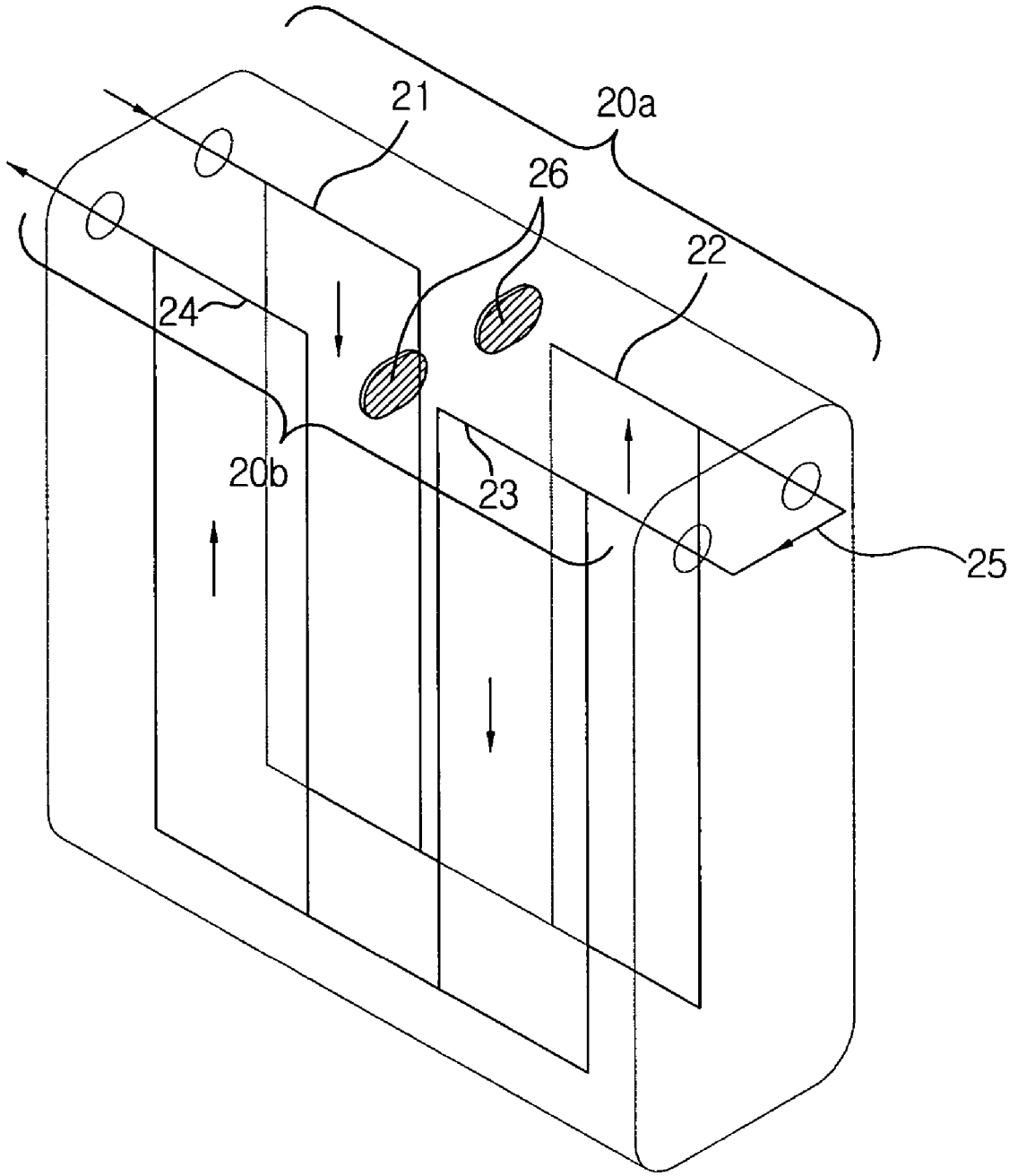
FIG. 2 is a view showing a flow of refrigerant of the conventional heat exchanger.
Figure 3:
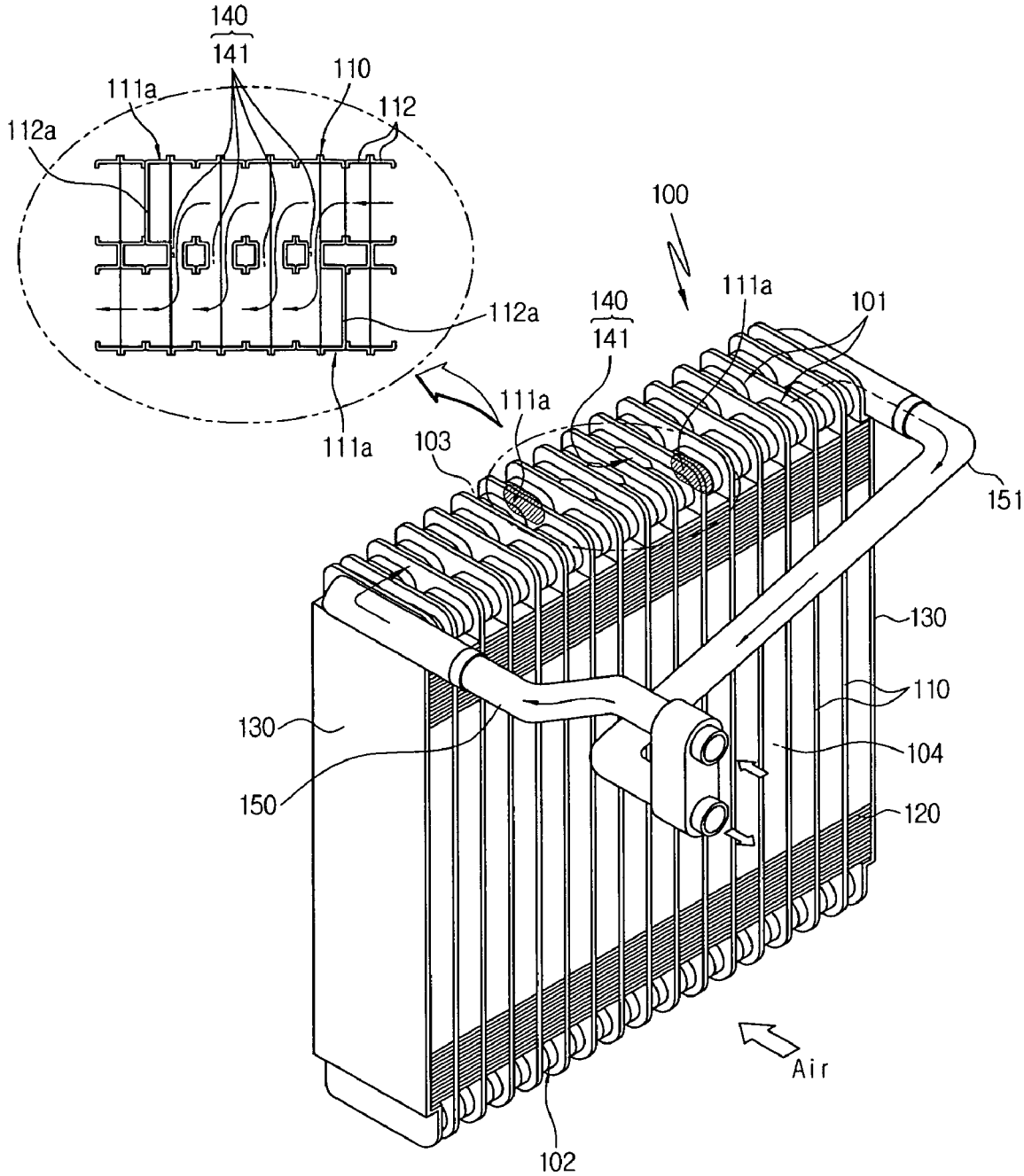
FIG. 3 is a perspective view of a heat exchanger according to a first preferred embodiment of the present invention.
Figure 4:
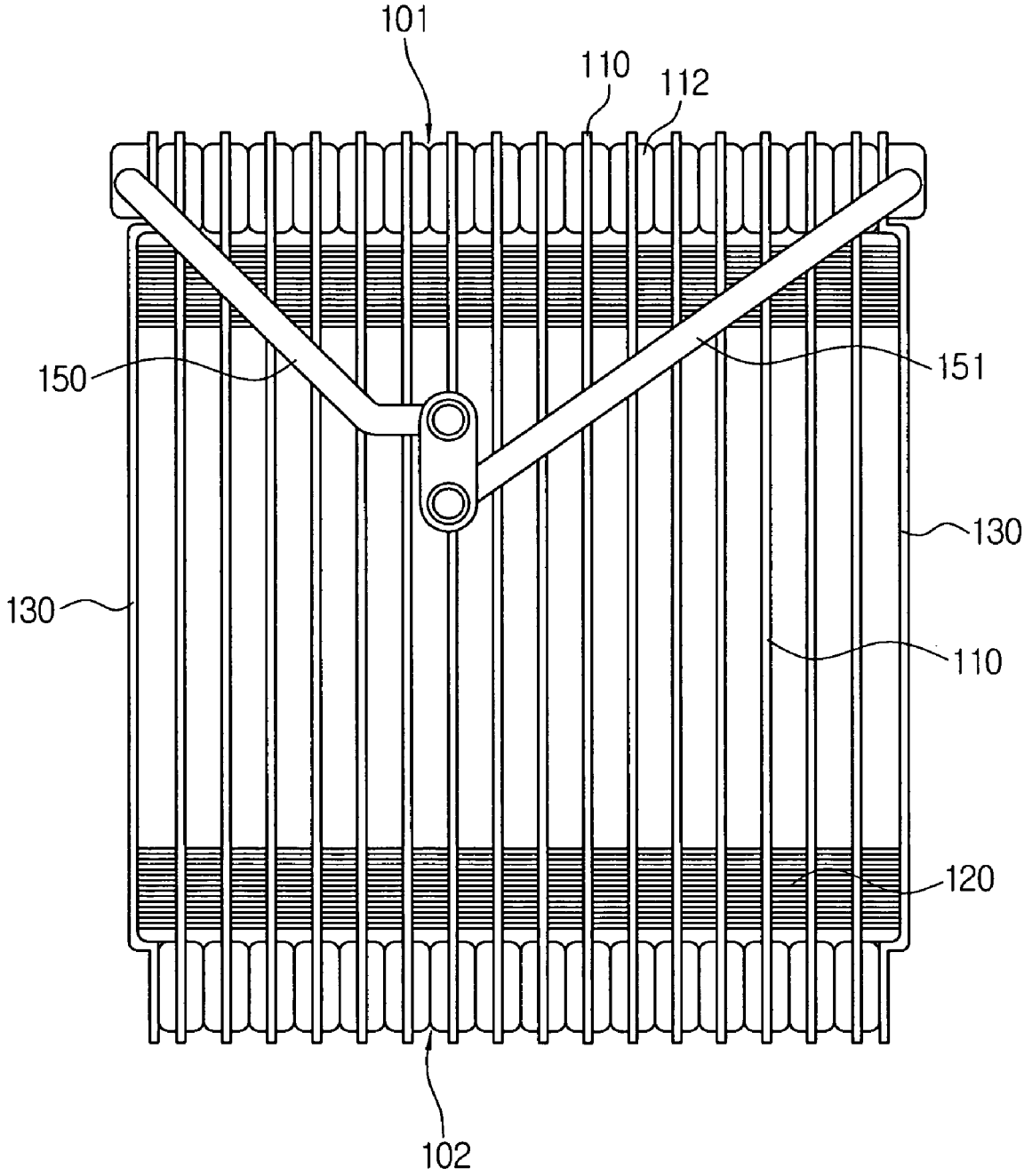
FIG. 4 is a front view of the heat exchanger according to the first preferred embodiment.
Figure 5:
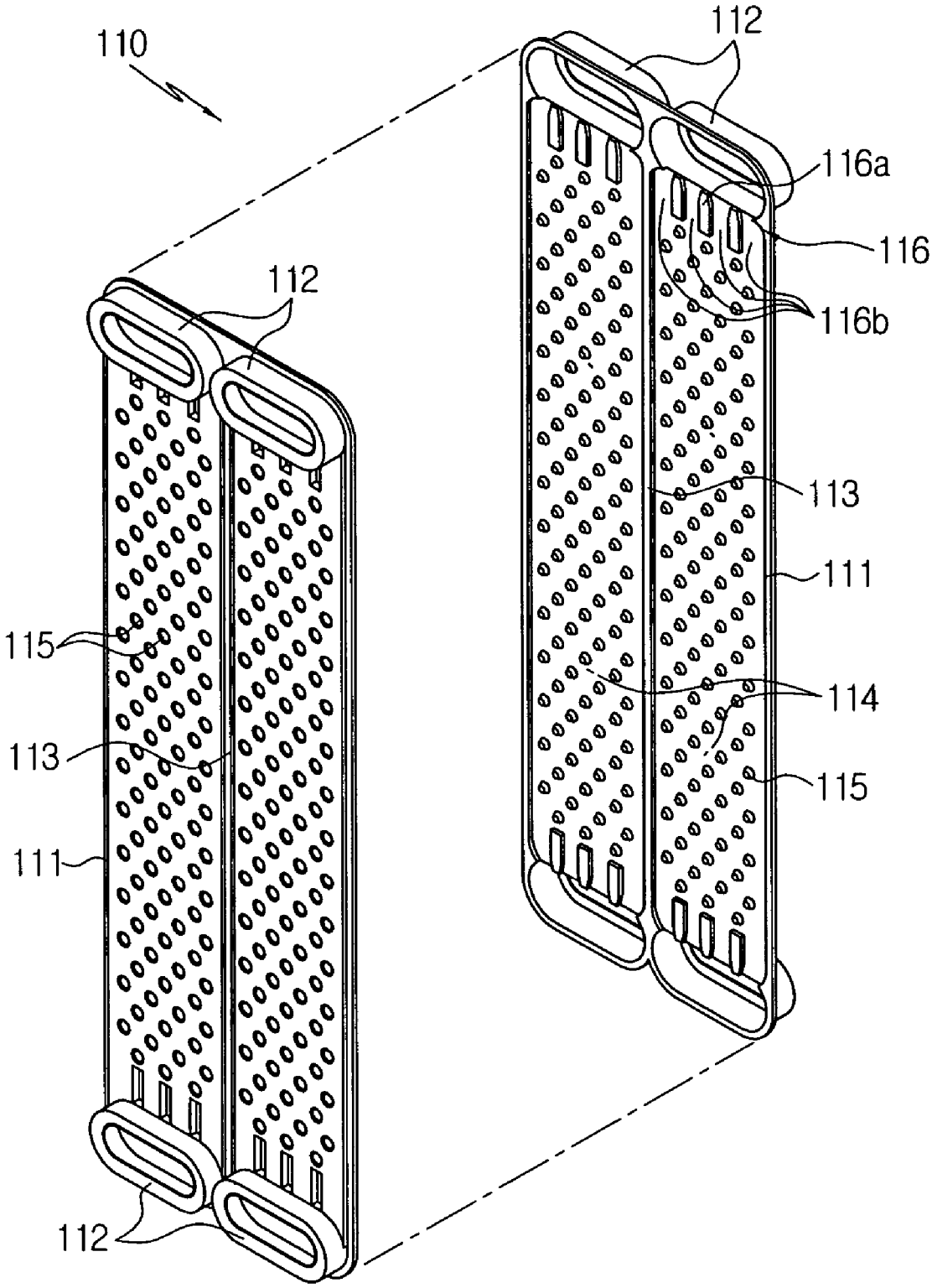
FIG. 5 is a perspective view showing a state where a general tube is separated from the heat exchanger according to the first preferred embodiment.
Figure 6:
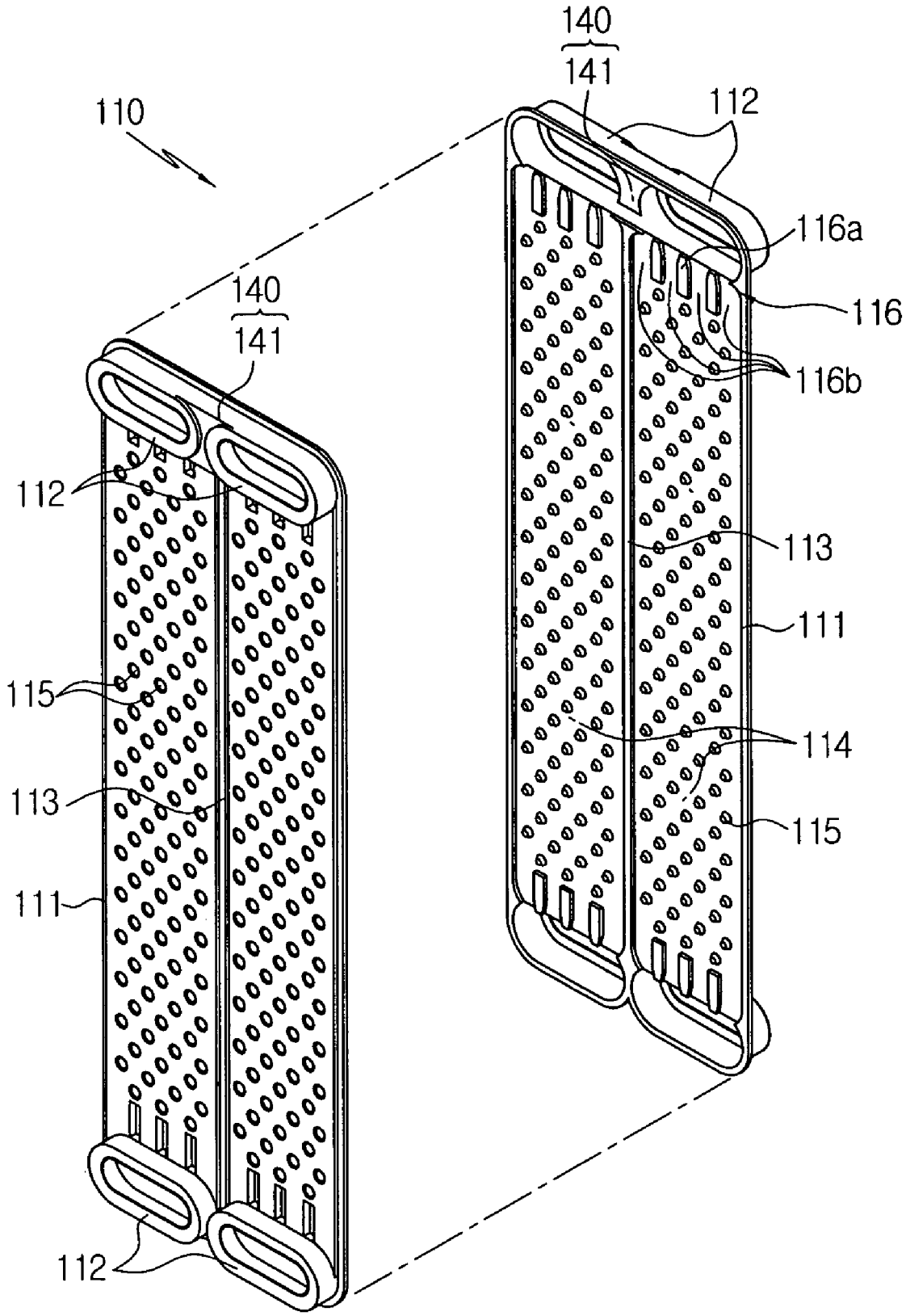
FIG. 6 is a perspective view showing a state where a tube which has a fluid communication passageway is separated from the heat exchanger according to the first preferred embodiment.
Figure 7:
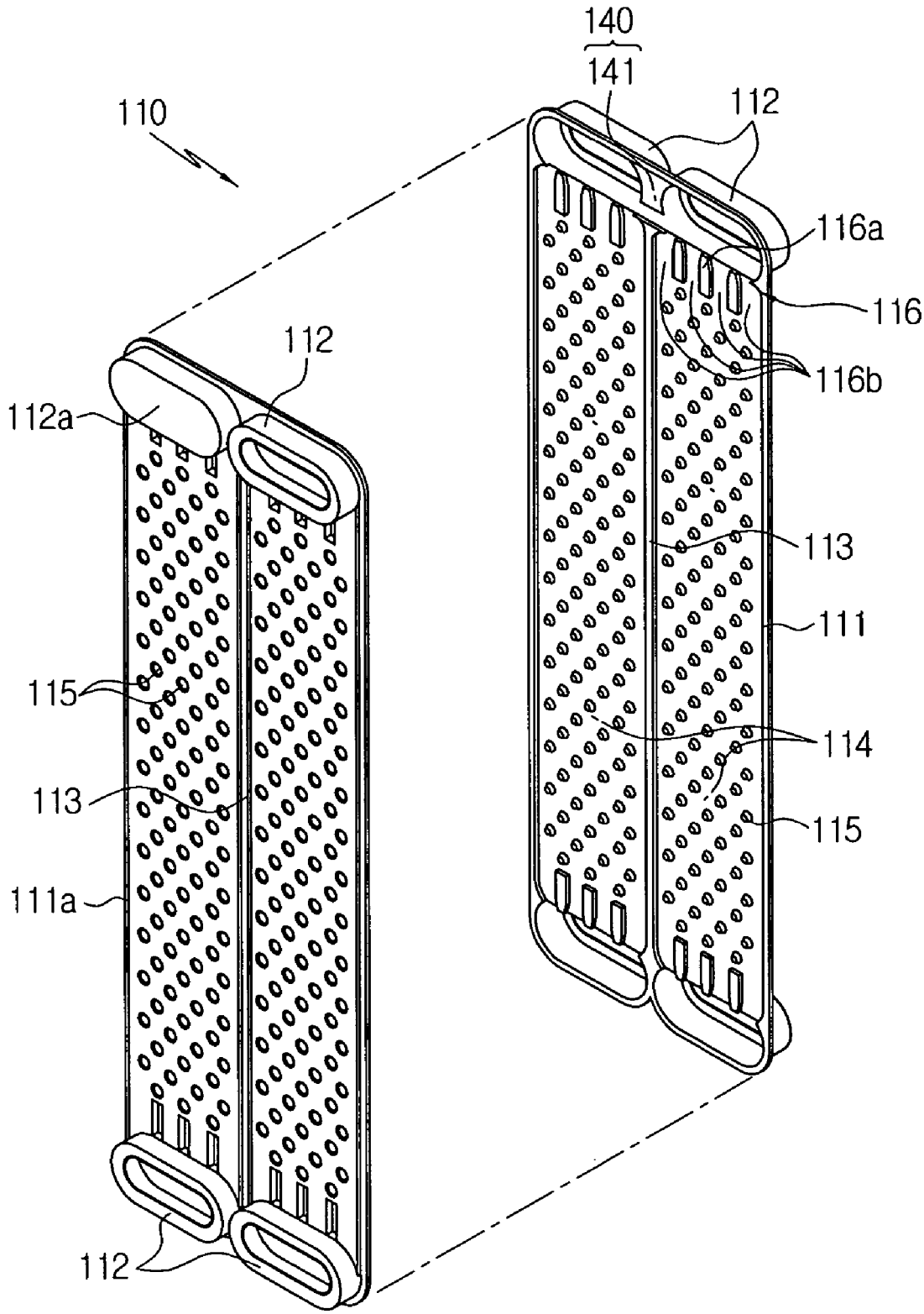
FIG. 7 is a perspective view showing a state where a blank plate is separated from the heat exchanger according to the first preferred embodiment.
Figure 8:
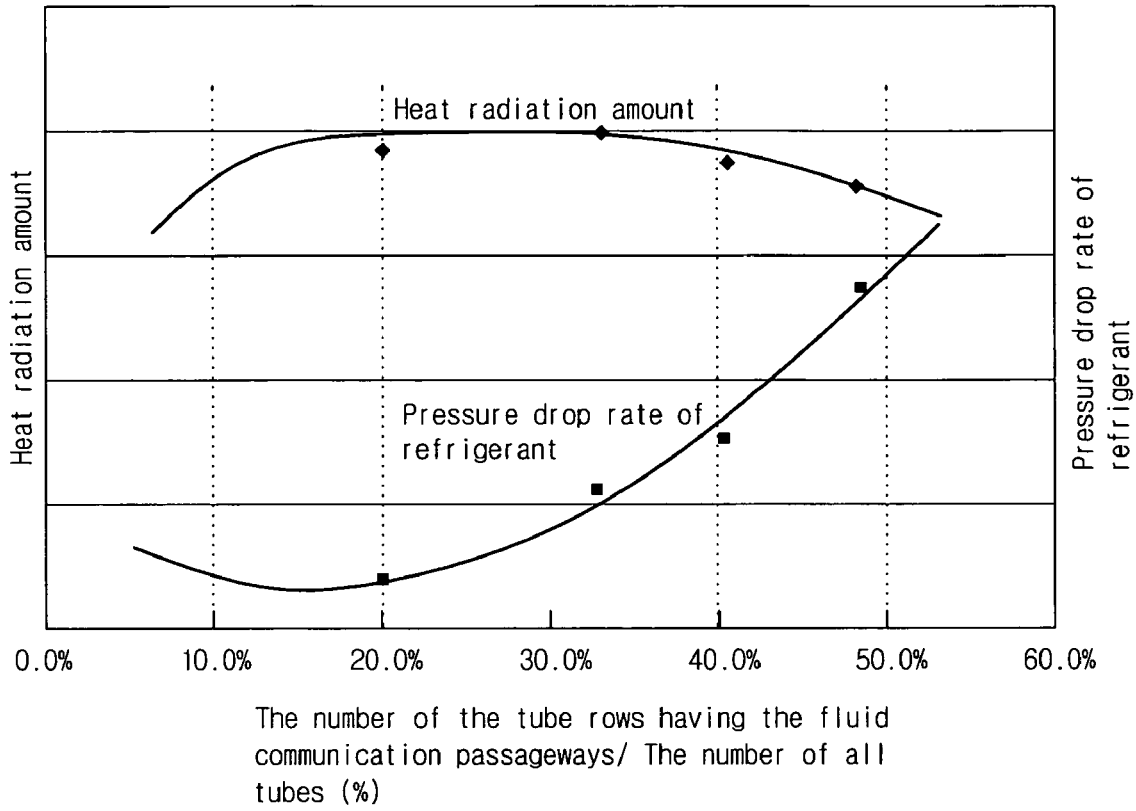
FIG. 8 is a graph showing a heat radiation amount and a pressure drop rate of refrigerant according to the ratio of the number of the tube rows having the fluid communication passageways to the number of all tubes.
Figure 9:
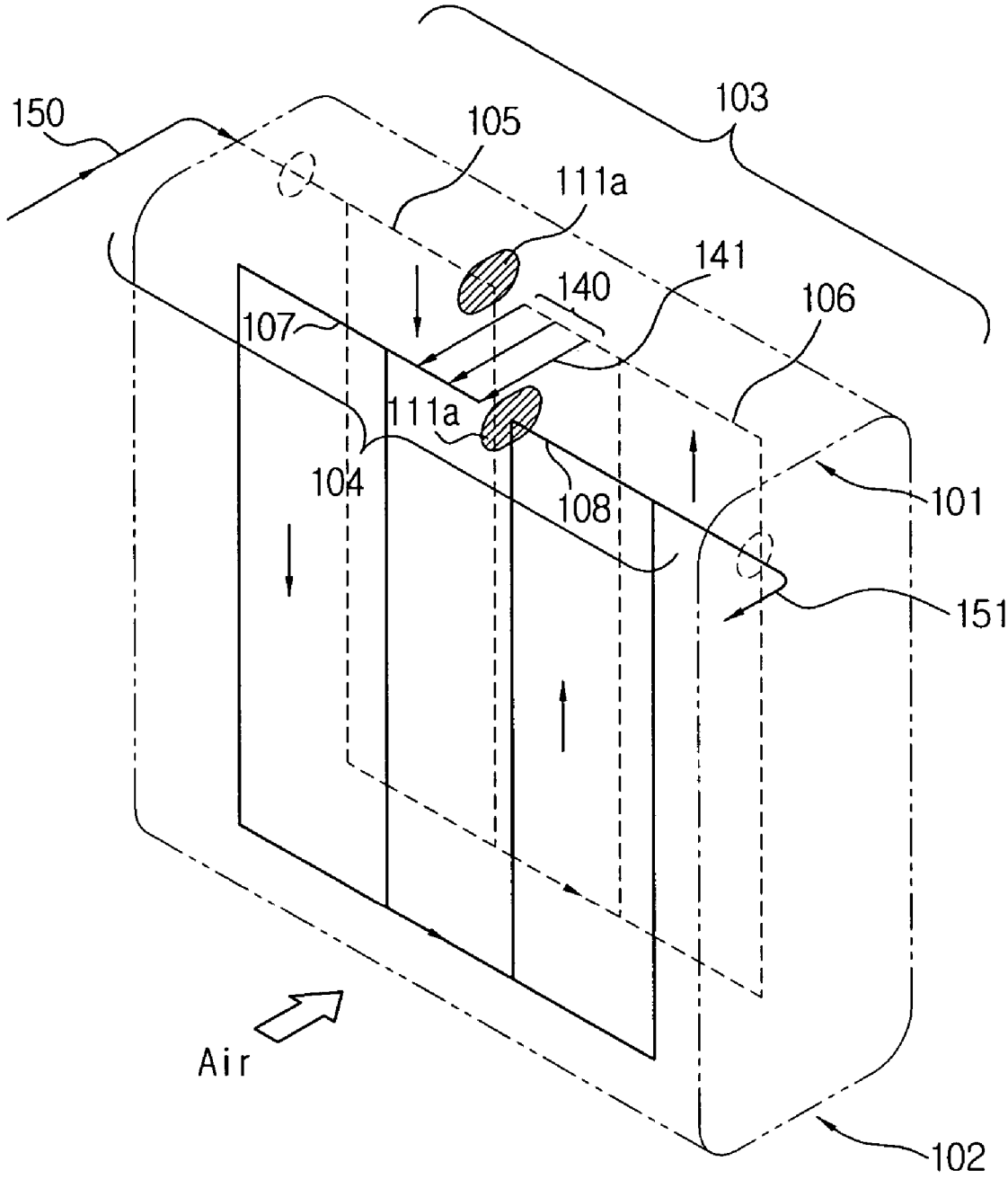
FIG. 9 is a view showing a flow of refrigerant of the heat exchanger according to the first preferred embodiment.
Figure 10:
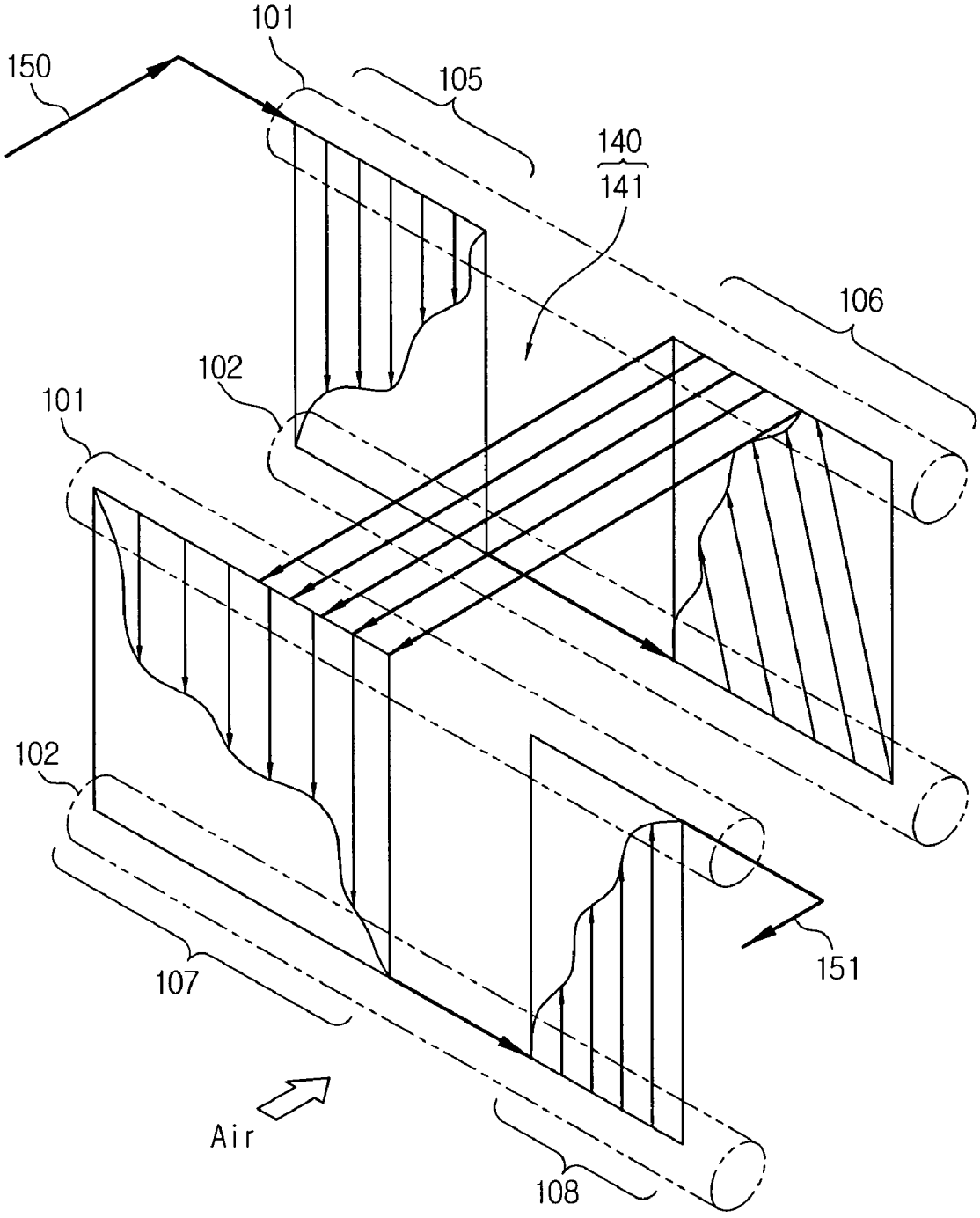
FIG. 10 is a view showing a refrigerant distribution in the heat exchanger according to the first preferred embodiment.

FIG. 3 is a perspective view of a heat exchanger according to a first preferred embodiment of the present invention, FIG. 4 is a front view of the heat exchanger according to the first preferred embodiment, FIG. 5 is a perspective view showing a state where a general tube is separated from the heat exchanger according to the first preferred embodiment, FIG. 6 is a perspective view showing a state where a tube which has a fluid communication passageway is separated from the heat exchanger according to the first preferred embodiment, FIG. 7 is a perspective view showing a state where a blank plate is separated from the heat exchanger according to the first preferred embodiment, FIG. 8 is a graph showing a heat radiation amount and a pressure drop rate of a refrigerant side according to the ratio of the number of the tube rows having the fluid communication passageways to the number of all tubes, FIG. 9 is a view showing a flow of refrigerant of the heat exchanger according to the first preferred embodiment, and FIG. 10 is a view showing a refrigerant distribution in the heat exchanger according to the first preferred embodiment.

As shown in the drawings, the heat exchanger 100 according to the first preferred embodiment of the present invention is formed by laminating a plurality of tubes 110 in multi layers, each of which has flow channels 114 formed therein for a flow of refrigerant.

The tube 110 includes: a pair of plates 111 bonded with each other; two discrete flow channels 114 formed therein; a partition bead 113 interposed between the two flow channels 114 and vertically formed at the center thereof; and pairs of cups 112 protruding from the upper and lower ends thereof, formed in a row and respectively fluidically communicating with the flow channels 114.

Furthermore, tanks 101 and 102 are formed at the upper and lower portions of the tube 110 in such a way that the cups 112 are bonded with each other.

Meanwhile, neck-type bead parts 116 having a plurality of passageways 116*b* divided by at least one second bead 116*a* are formed at the inlet and outlet sides of each flow channel 114 of the tube 110, so that refrigerant is distributed uniformly and induced into the flow channel 114.

Moreover, in each plate 111, a plurality of first beads 115 are projected inward via embossing along the flow channel 114. The first beads 115 are arrayed regularly and diagonally in the form of a lattice to improve the fluidity of refrigerant while creating a turbulent flow. The partition bead 113 and the first beads 115 respectively formed by the plates 111 are in contact with each other and then coupled together via brazing.

Meanwhile, heat radiation fins 120 are interposed between the tubes 110 to promote heat exchange, and end plates 130 are mounted at the outermost sides of the tubes 110 and the heat radiation fins 120 to reinforce the same.

Furthermore, an inlet pipe 150 and an outlet pipe 151 are mounted at both ends of one of the upper and lower tanks 101 and 102 for inducing and discharging refrigerant. That is, the inlet and outlet pipes 150 and 151 are mounted in such a way as to fluidically communicate with the two flow channels 114 located at the front and rear arrays of the tubes 110. Moreover, the location of the inlet and outlet pipes 150 and 151 can be changed more freely if a flow channel is formed on the end plate 130. For instance, the inlet pipe 150 may be mounted on the upper tank 101, and the outlet pipe 151 may be mounted on the lower tank 102.

Hereinafter, a case where the inlet and outlet pipes 150 and 151 are mounted on the upper tank 101 will be described.

In the piled-up tubes 110, an inlet side heat exchange part 103 is formed at the rear side of the tubes 110 which fluidically communicates with the inlet pipe 150, and an outlet side heat exchange part 104 is formed at the front side of the tube 110 which fluidically communicates with the outlet pipe 151.

Moreover, fluid communication means 140 for fluidically communicating predetermined areas of the tanks 101 of the inlet and outlet side heat exchange parts 103 and 104 with each other, whereby refrigerant flowing inside the inlet side heat exchange part 103 and refrigerant flowing inside the outlet side heat exchange part 103 have the same flow direction since the inlet side heat exchange part 103 and the outlet side heat exchange part are fluidically communicated with each other.

That is, in the inlet and outlet side heat exchange parts 103 and 104, refrigerant flows downward from the upper tank 101, is returned at the lower tank 102, and then, flows upward toward the upper tank 101 by the partitioning of the blank plate 111*a* which will be described later.

Therefore, all of the inlet and outlet side heat exchange parts 103 and 104 have the same refrigerant flowing structure in such a fashion that, based on the blank plate 111*a*, refrigerant at the inlet pipe 150 side flows downward from the upper tank 101 to the lower tank 102, and refrigerant at the outlet pipe 151 side flows upward from the lower tank 102 to the upper tank 101.

The fluid communication means 140 is formed by forming a fluid communication passageway 141 to fluidically communicate a pair of the cups 112 of the tubes 110 in the predetermined area, and the fluid communication passageway 141 is formed at the top of the tube 110.

Here, it is preferable that the fluid communication means 140 is formed in such a fashion as to fluidically communicate 10~50% areas of the upper tanks 101 of the inlet and outlet side heat exchange parts 103 and 104 with each other by contrast with the entire size of the upper tanks 101. That is, the number of the tubes 110 on which the fluid communication means 140 are formed respectively is within 10~50% of the number of the entire tubes 110.

FIG. 8 is a graph showing a heat radiation amount and a pressure drop rate of refrigerant according to the ratio of the number of the tube rows having the fluid communication passageways to the number of all tubes. As shown in FIG. 8, the optimum ratio of the number of the tubes having fluid communication means 140 is 10~50%. If the ratio is less than 10%, the pressure drop rate of refrigerant is increased and the heat radiation amount is decreased. In addition, if the ratio is more than 50%, the pressure drop rate of refrigerant is increased and the heat radiation amount is decreased while a refrigerant channel group f the outlet side heat exchange part 104 on which the outlet pipe 151 is mounted becomes smaller.

Meanwhile, it is preferable that the ratio of the number of the array of the tubes having the fluid communication passageways 141 to the number of the array of the entire tubes of the heat exchanger 100 is 20~40% in consideration of the pressure drop rate of refrigerant and the heat radiation amount.

Moreover, it is preferable that the fluid communication means 140 is formed at an approximately central portion of the heat exchanger 100. Additionally, it is possible to properly select the number of the tubes 110 having the fluid communication passageways 141 in consideration of the refrigerant distribution and the pressure drop rate of refrigerant or the heat exchange efficiency.

Furthermore, the fluid communication passageways 141 may have the same size or different sizes. The fluid communication passageways 141 are not formed consecutively, and can be formed partially only at necessary portions in such a way as to close at least one fluid communication passageway 141 at the center of the array of the fluid communication passageways 141.

The blank plates 111*a* divides the inlet and outlet side heat exchange parts 103 and 104 into a plurality of heat exchange zones 105~108, and are mounted in such a fashion that portions of the heat exchange zones 106 and 107 fluidically communicating with each other via the fluid communication means 140 are mutually overlapped.

The blank plates 111*a* are mounted at both sides of the fluid communication means 140, and at this time, a pair of the cups 112*a* located diagonally are closed.

Therefore, the inlet and outlet side heat exchange parts 103 and 104 are divided into first to fourth heat exchange zones 105~108 by the blank plates 111*a*. Here, the first heat exchange zone 105 and the fourth heat exchange zone 108 which are located diagonally and between which the blank plate 111*a* is interposed have similar areas with each other. The second heat exchange zone 106 and the third heat exchange zone 107 fluidically communicated with each other via the fluid communication means 140 have similar areas with each other. Moreover, the second and third heat exchange zones 106 and 107 are partially overlapped by the fluid communication means 140.

Meanwhile, the first to fourth heat exchange zones 105~108 can freely change the heat exchange areas according to the location of the blank plate 111*a*.

Furthermore, in the case where at least one blank plate 111*a* which closes the cup 112 at a specific portion is additionally mounted at a specific location of the heat exchanger 100, the frequency of upward and downward flowing of refrigerant can be increased, whereby the fluid communication means 140 can be formed at the lower tank 102 for more various flow channel structures.

Hereinafter, referring to FIG. 8, the refrigerant flow of the heat exchanger 100 according to the first preferred embodiment will be described.

First, refrigerant induced through the inlet pipe 150 is returned at the first heat exchange zone 105 toward the second heat exchange zone 106 of the inlet side heat exchange part 103, and then, flows to the outlet side heat exchange part 104 through the fluid communication means 140. After that, refrigerant induced into the outlet side heat exchange part 104 is returned at the third heat exchange zone 107 toward the fourth heat exchange zone 108, and then, discharged to the outlet pipe 151.

In more concretely, refrigerant induced into the upper tank 101 of the first heat exchange zone 105 through the inlet pipe 150 flows downward along the tubes 110, and moves toward the lower tank 102. Refrigerant moved into the lower tank 102 flows toward the lower tank 102 of the second heat exchange zone 106.

Refrigerant flowing into the lower tank 102 of the second heat exchange zone 106 flows upward along the tubes 110, and then, completes heat exchange at the inlet side heat exchange part 103 while moving toward the upper tank 101.

Continuously, refrigerant flowing into the upper tank 101 of the second heat exchange zone 106 flows toward the upper tank 101 of the third heat exchange zone 107 through the fluid communication passageway 141 formed at the top of the tube 110.

Refrigerant induced into the upper tank 101 of the third heat exchange zone 107 flows downward along the tubes 110, and moves toward the lower tank 102. Refrigerant moved into the lower tank 102 flows toward the lower tank 102 of the fourth heat exchange zone 108.

Refrigerant flowing into the lower tank 102 of the fourth heat exchange zone 108 flows upward along the tubes 110, and then, completes heat exchange at the outlet side heat exchange part 104 while moving toward the upper tank 101. After that, refrigerant is discharged to the outside through the outlet pipe 151.

As described above, also the heat exchanger 100 according to the present invention is influenced by gravity and inertia during the refrigerant flowing process as shown in FIG. 9. However, since the inlet side heat exchange part 103 and the outlet side heat exchange part 104 have the same refrigerant flowing direction, the first heat exchange zone 105 and the third heat exchange zone 107 having the same air flowing direction are all influenced by gravity acting to the downwardly flowing refrigerant but have different heat exchange areas, and the second heat exchange zone 106 and the fourth heat exchange zone 108 are all influenced by inertia acting to refrigerant upwardly flowing along the tubes 110 but have different heat exchange areas.

Moreover, in the second heat exchange zone 106, the direction of refrigerant flowing lopsidedly to end portions of the tanks 101 and 102 is changed to the direction of refrigerant flowing lopsidedly to the fluid communication means 140, whereby preponderance of refrigerant can be somewhat prevented and refrigerant can flow to each tube 110 uniformly. That is, in the second heat exchange zone 106, the amount of refrigerant flowing along the tubes 110 is gradually increased toward the end portions of the tanks 101 and 102 due to inertia, but the direction of refrigerant flowing lopsidedly to the end portions of the tanks 101 and 102 can be changed to the fluid communication means 140 by mounting the fluid communication means 140 at the central area of the heat exchanger 100.

Therefore, the air passing through an overcooled section of the outlet side heat exchange part 104 passes through an overheated section of the inlet side heat exchange part 103 as much as possible, and the air passing through an overheated section of the outlet side heat exchange part 104 passes through an overcooled section of the inlet side heat exchange part 103 as much as possible, whereby the inlet and outlet side heat exchange parts 103 and 104 exchanges heat with each other so that the entire surface temperature distribution of the heat exchanger 100 becomes uniform due to decrease of a surface temperature difference.

Moreover, due to the fluid communication means 140 formed at the predetermined area between the inlet pipe 150 and the outlet pipe 151, the pressure drop rate of refrigerant can be reduced and the heat exchange efficiency is improved so that the heat exchanger can be reduced in size. Additionally, by the above flow channel structure, since the inlet and outlet pipes 150 and 151 can be mounted at both sides of the upper tank 101, they can be easily arranged forward. Therefore, in the case where the heat exchanger 100 is installed on a case of an air-conditioner, a refrigerant piping design can be freely achieved.

Figure 11:
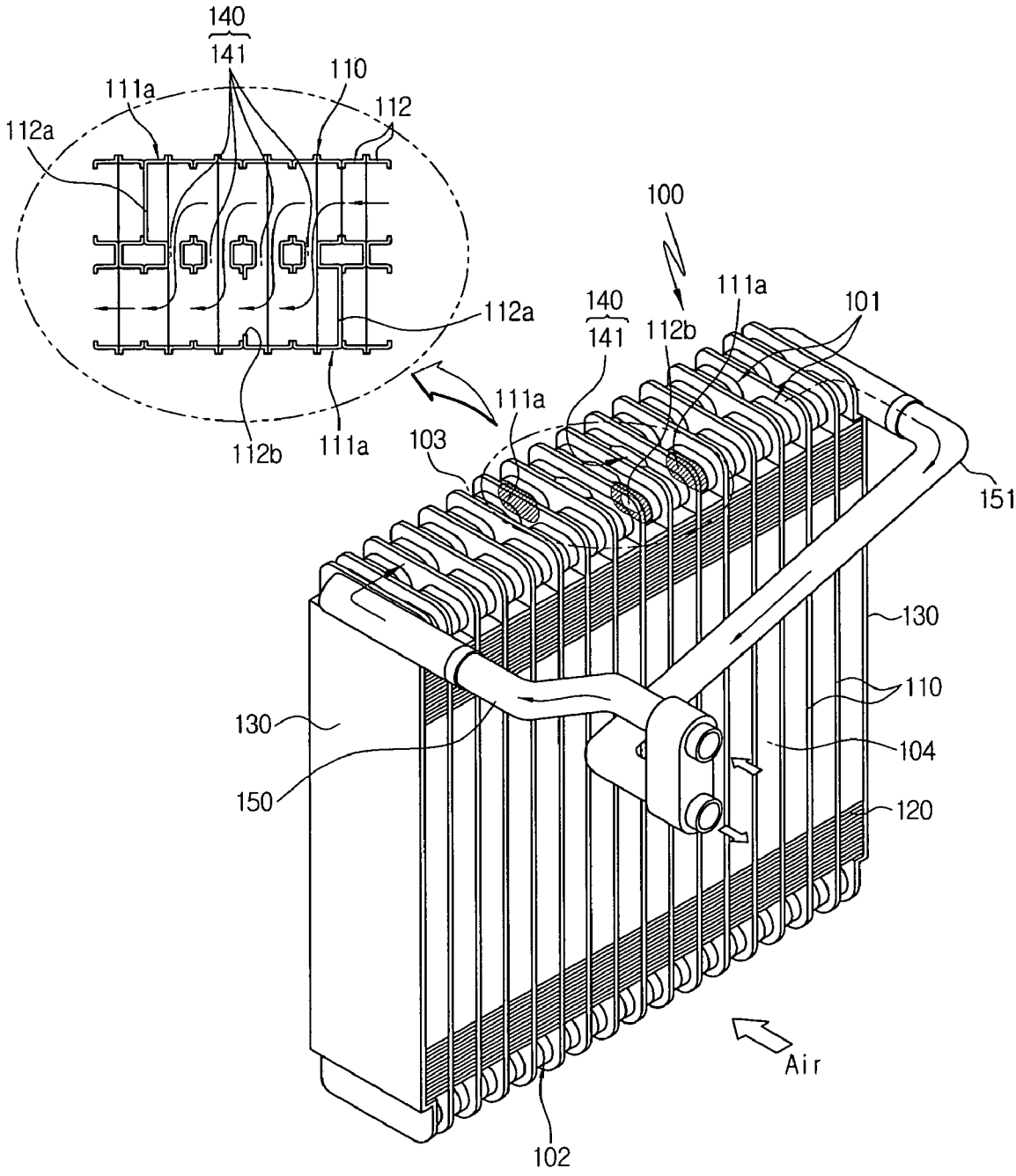
FIG. 11 is a perspective view of a heat exchanger according to a second preferred embodiment of the present invention.

FIG. 11 is a perspective view of a heat exchanger according to a second preferred embodiment of the present invention. Only parts different from the first embodiment will be described, but description of the same parts as the first embodiment will be omitted.

As shown in FIG. 11, the second embodiment has the same constitution as the first embodiment. However, in the second embodiment, the heat exchanger 100 includes a distribution hole 112*b* formed at one of the upper and lower tanks 101 and 102 and has a sectional area smaller than that of the passageway of the tank 101 or 102 in order to improve the heat exchange efficiency by promoting evaporation of refrigerant.

Here, the distribution hole 112*b* is formed at the upper end cup 112 of the tube 110 having the fluid communication means 140, and it is preferable that the distribution hole 112*b* is formed in the outlet side heat exchange part 104 rather than the inlet side heat exchange part 103. Of course, a plurality of the distribution holes 112*b* can be formed at various locations of the inlet and outlet side heat exchange parts 103 and 104.

Therefore, a portion of refrigerant pass through the distribution hole 112*b* when it flows from the inlet side heat exchange part 103 to the outlet side heat exchange part 104 through the fluid communication means 140. During the above process, refrigerant is atomized (into small particles such as mists) and rapidly evaporated, and thereby, the heat exchange efficiency is improved.

Figure 12:
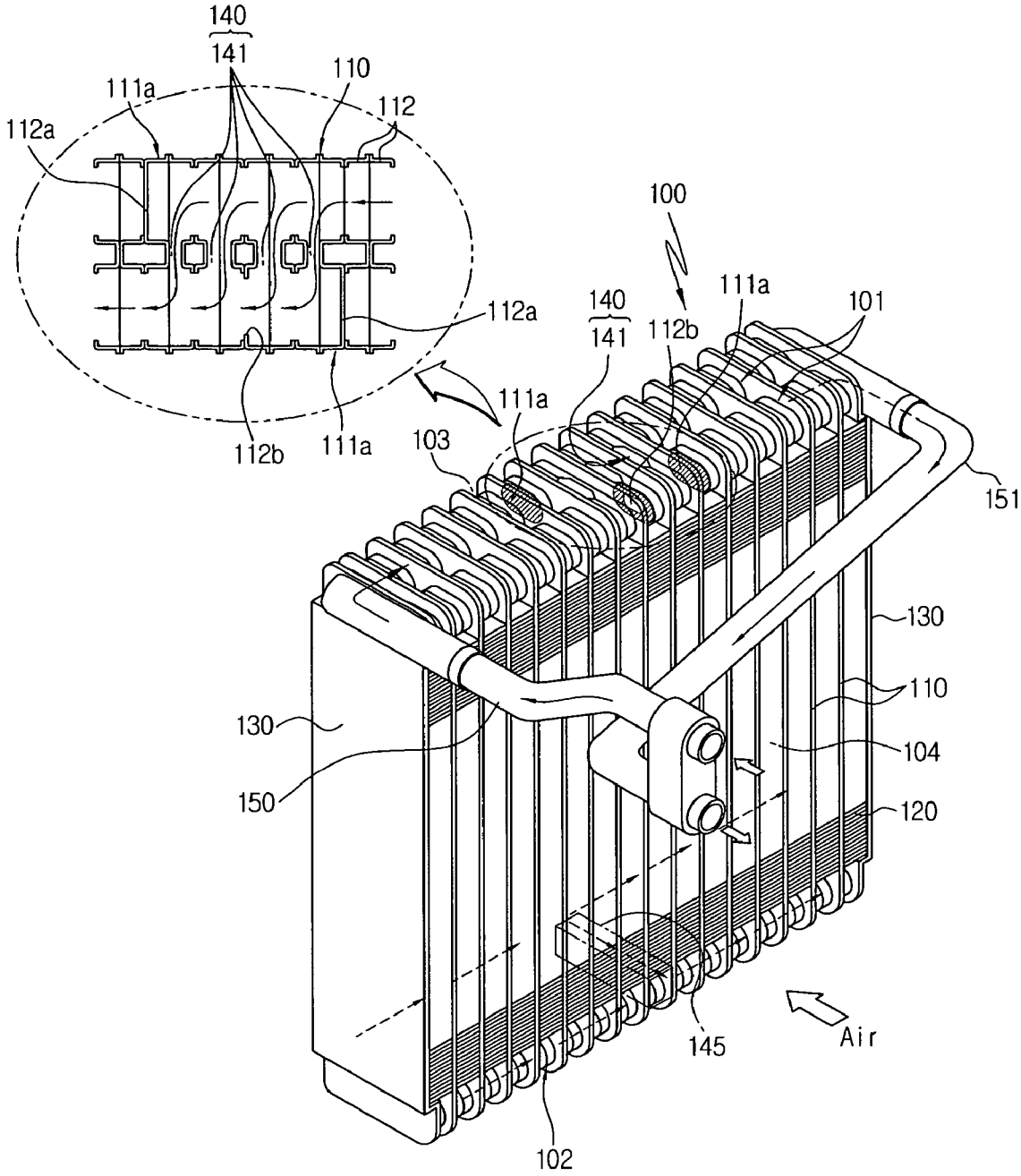
FIG. 12 is a perspective view of a heat exchanger according to a third preferred embodiment of the present invention.
Figure 13:
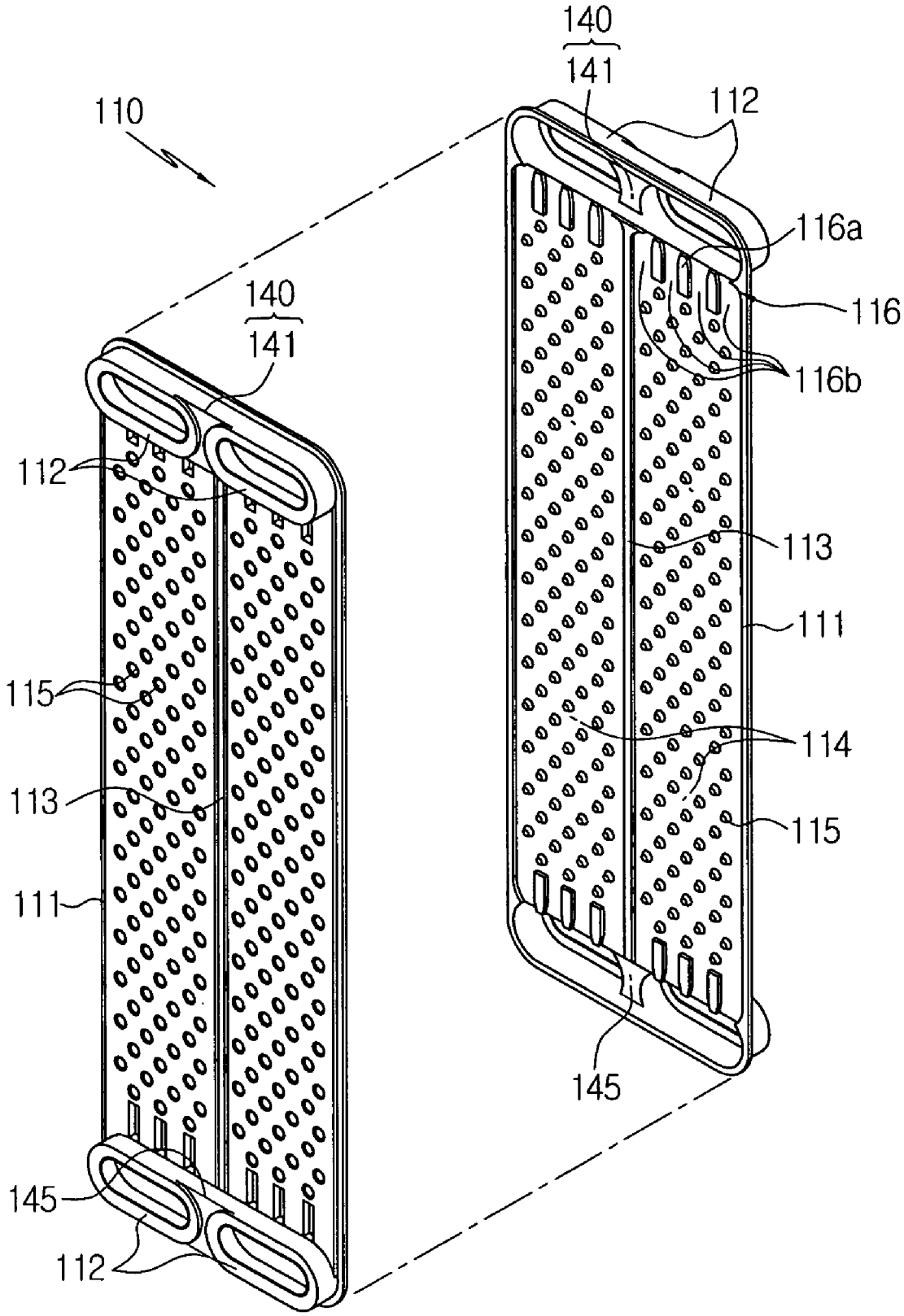
FIG. 13 is a perspective view showing a state where a tube which has a fluid communication passageway formed at the upper end thereof and a bypass passageway formed at the lower end thereof is separated from the heat exchanger according to the third preferred embodiment.

FIG. 12 is a perspective view of a heat exchanger according to a third preferred embodiment of the present invention, and FIG. 13 is a perspective view showing a state where a tube which has a fluid communication passageway formed at the upper end thereof and a bypass passageway formed at the lower end thereof is separated from the heat exchanger according to the third preferred embodiment. Only parts different from the second embodiment will be described, but description of the same parts as the second embodiment will be omitted.

As shown in FIGS. 12 and 13, in the third embodiment, the heat exchanger according to the present invention has the same constitution as the second embodiment. However, the heat exchanger according to the third embodiment includes a bypass passageway 145 formed at least one tube 110 for fluidically communicating a pair of the cups 112 with each other which are located at the refrigerant returning area, whereby a portion of refrigerant which is returned at the lower tank 102 of the inlet side heat exchange part 103 is bypassed to the lower tank 102 of the outlet side heat exchange part 104.

Therefore, when a flow amount of refrigerant flowing inside the heat exchanger 100 is small, a portion of refrigerant flowing inside the inlet side heat exchange part 103 is directly bypassed to the outlet side heat exchange part 104 through the bypass passageway 145, so that the outlet side air temperature distribution is improved.

Figure 14:
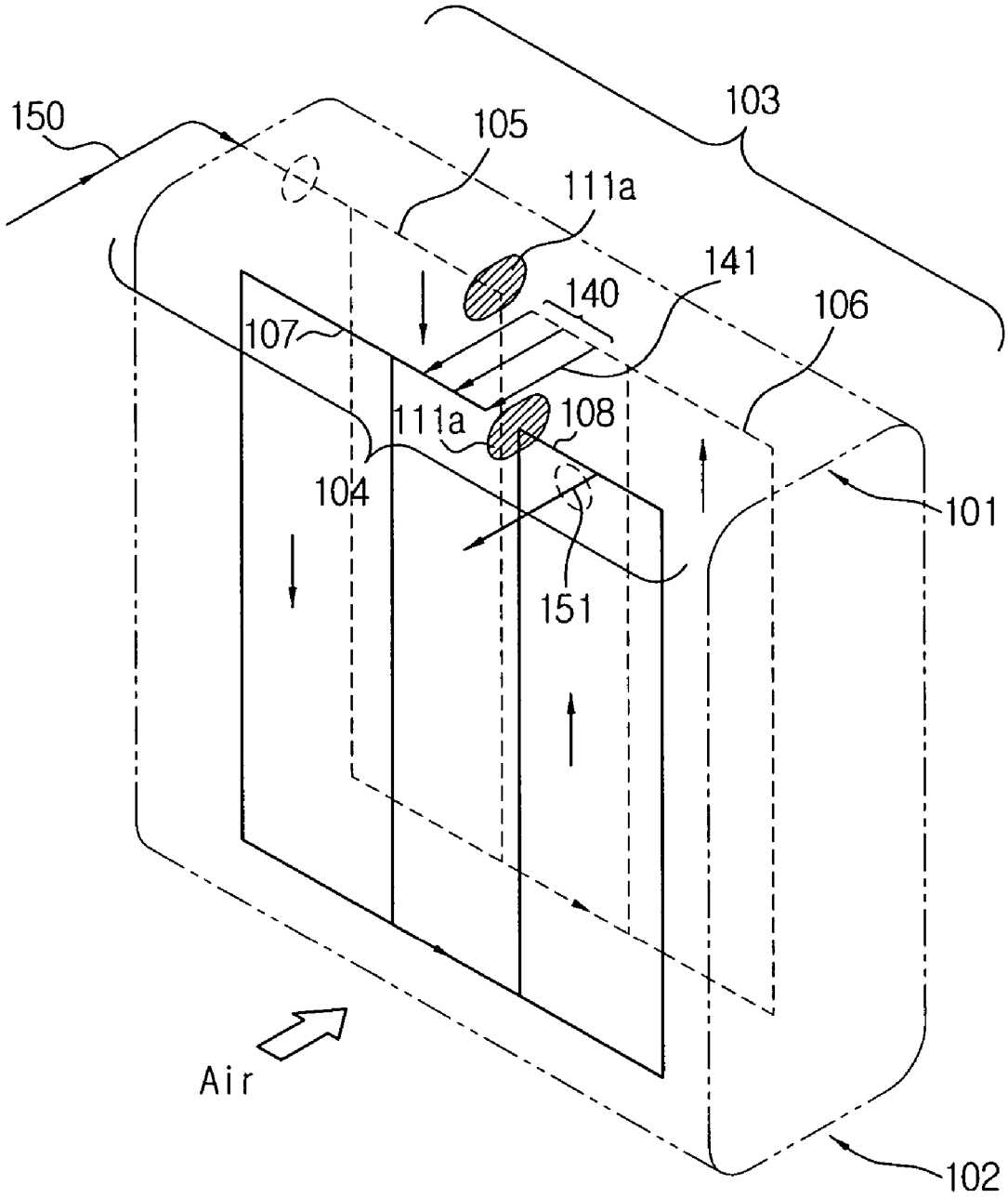
FIG. 14 is a view showing a flow of refrigerant of a heat exchanger according to a fourth preferred embodiment of the present invention.

FIG. 14 is a view showing a flow of refrigerant of a heat exchanger according to a fourth preferred embodiment of the present invention. Only parts different from the first embodiment will be described, but description of the same parts as the first embodiment will be omitted.

As shown in FIG. 14, in the fourth embodiment, the heat exchanger according to the present invention has the same constitution as the first embodiment. However, in the fourth embodiment, the outlet pipe 151 is mounted at the center of the fourth heat exchange zone 108 which is the last heat exchange zone of the outlet side heat exchange part 104.

In the first embodiment, the flow of refrigerant may be lopsided to the end portion by inertia since the outlet pipe 151 is located at the end portion of the heat exchanger 100. That is, refrigerant flows very rapidly in the outlet side heat exchange part 104 since it is in a gas state therein. Furthermore, since the outlet side heat exchange part 104 is very sensitive to refrigerant flowing noise, if refrigerant is lopsided in the outlet side heat exchange part 104, the refrigerant flowing noise may be generated, and ununiform refrigerant distribution and uneven temperature may be caused.

Therefore, in the fourth embodiment, the outlet pipe 151 is mounted at the center of the fourth heat exchange zone 108 which is the last heat exchange zone of the outlet side heat exchange part 104 so that the lopsidedness of refrigerant at the outlet side heat exchange part 104 which is more overheated than the inlet side heat exchange part 103 is prevented and the refrigerant distribution becomes uniform, whereby the refrigerant flowing noise is reduced and also the temperature becomes uniform by reducing the lopsidedness of refrigerant toward the outlet pipe 151 due to inertia.

As described above, the inlet and outlet side heat exchange parts are fluidically communicated with each other and have the same refrigerant flowing direction by communicating a pair of the cups with each other which are located at the predetermined area of the center of the heat exchanger, whereby the heat exchanger can be reduced in size by reducing the preponderance and the pressure drop rate of refrigerant and by mutually complementarily exchanging heat between the inlet and outlet side heat exchange parts, and the surface temperature distribution of the heat exchanger becomes uniform and the heat exchange efficiency is improved.

Moreover, the ratio of the fluid communication means (fluid communication passageways) to the entire size of the heat exchanger is within 10~50% in order to obtain the optimum heat radiation amount.

Additionally, by the above flow channel structure, since the inlet and outlet pipes can be mounted at both sides of the upper tank, they can be easily arranged forward.

Furthermore, since the distribution hole having the sectional area smaller than that of the passageway of the tank is formed inside the tank, refrigerant passing through the distribution hole is atomized and rapidly evaporated, and the heat exchange efficiency is improved.

In addition, since the heat exchanger includes the bypass passageway for allowing bypass of a portion of refrigerant returned at the inlet side heat exchange part toward the outlet side heat exchange part, when the flow amount of refrigerant flowing inside the heat exchanger is small, a portion of refrigerant flowing inside the inlet side heat exchange part is directly bypassed to the outlet side heat exchange part through the bypass passageway, so that the outlet side air temperature distribution is improved.

Furthermore, since the outlet pipe is mounted at the center of the fourth heat exchange zone which is the last heat exchange zone of the outlet side heat exchange part, lopsidedness of refrigerant and the refrigerant flowing noise can be reduced, and the temperature can be uniform.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A heat exchanger comprising:

a plurality of tubes each formed by bonding a pair of plates with each other, the tube having two flow channels formed therein, a partition bead interposed between the two flow channels, and pairs of cups formed at the upper and lower ends thereof in a row in such a manner as to communicate with each flow channel, the cups being coupled to each other so as to form upper and lower tanks;

inlet and outlet pipes respectively communicated with said two flow channels for allowing flow-in and flow-out of refrigerant;

an inlet side heat exchange part adapted to communicate with the inlet pipe at the tubes;

an outlet side heat exchange part adapted to communicate with the outlet pipe at the tubes;

fluid communication means for intercommunicating predetermined areas of the tanks to which the inlet and/or outlet pipes are mounted by communicating the inlet and outlet side heat exchange parts with each other in such a fashion that all of the inlet and outlet side heat exchange parts adjacent to each other in an air flow direction have the same refrigerant flow direction, and such that the refrigerant flow direction through the fluid communication means is not the same; and blank plates dividing the inlet and outlet side heat exchange parts into a plurality of heat exchange zones, the blank plates being formed by closing cups located diagonally on both ends of the fluid communication means in such a fashion that portions of the heat exchange zones including at least one of the tubes and communicating with each other via the fluid communication means are mutually overlapped.

2. The heat exchanger according to claim 1, wherein the fluid communication means is formed by forming a fluid communication passageway to communicate a pair of the cups of the tubes in the predetermined area.

3. A heat exchanger according to claim 1, wherein the area of the tanks of the inlet and outlet side heat exchange parts communicated with each other by the fluid communication means are 10~50% of the entire area of the tanks.

4. The heat exchanger according to claim 2, wherein the ratio of the number of the array of the tubes having the fluid communication passageway to the number of the array of the entire tubes of the heat exchanger 100 is 20~40%.

5. The heat exchanger according to claim 2, wherein the fluid communication means is formed at a central area of the heat exchanger.

* * * * *

UNITED STATES PATENT AND TRADEMARK OFFICE

CERTIFICATE OF CORRECTION

PATENT NO. : 7,523,781 B2
APPLICATION NO. : 11/336705
DATED : April 28, 2009
INVENTOR(S) : Oh et al.

It is certified that error appears in the above-identified patent and that said Letters Patent is hereby corrected as shown below:

On the cover page, item [73], Assignee, change "Halls Climate Control Corporation" to -- Halla Climate Control Corporation --.

Signed and Sealed this

Thirtieth Day of June, 2009

JOHN DOLL
*Acting Director of the United States Patent and Trademark Office*